United States Patent [19]

Ayer et al.

[11] 4,194,805

[45] Mar. 25, 1980

[54] ELECTRICAL CONTACTING ELEMENT

[75] Inventors: George E. Ayer, Endicott; Hurley J. Blakeney, Gilbertsville, both of N.Y.

[73] Assignee: Bunker Ramo Corporation, Oak Brook, Ill.

[21] Appl. No.: 655,723

[22] Filed: Feb. 6, 1976

Related U.S. Application Data

[63] Continuation of Ser. No. 538,475, Jan. 6, 1975, abandoned, which is a continuation of Ser. No. 345,713, Mar. 28, 1973, abandoned.

[51] Int. Cl.[2] ..... H01R 13/40; H01R 13/62

[52] U.S. Cl. ..... 339/107; 29/764; 339/110 P; 339/210 M; 339/219 R

[58] Field of Search ..... 29/203 H, 509, 513; 339/45, 46, 107-110, 147, 195, 196, 206-210, 218, 219, 62, 63

[56] References Cited

U.S. PATENT DOCUMENTS

| | | | |
|---|---|---|---|
| 2,043,851 | 6/1936 | Grant et al. | 339/107 X |
| 2,305,101 | 12/1942 | O'Brien | 339/110 R |
| 2,458,203 | 1/1949 | Rohrman | 339/196 R |
| 2,502,860 | 4/1950 | Leithiser, Jr. | 339/196 R |
| 2,668,885 | 2/1954 | Gerlat | 339/107 |
| 2,723,381 | 11/1955 | Collins | 339/62 |
| 2,828,393 | 3/1958 | Wingard | 339/218 R |
| 3,187,291 | 6/1965 | Hime | 339/110 P |
| 3,549,783 | 12/1970 | Bendrick | 339/63 M |
| 3,641,482 | 2/1972 | Bretting | 339/210 M |

FOREIGN PATENT DOCUMENTS

| | | | |
|---|---|---|---|
| 692074 | 6/1940 | Fed. Rep. of Germany | 339/210 R |
| 676144 | 7/1952 | United Kingdom | 339/62 |

*Primary Examiner*—Neil Abrams

*Attorney, Agent, or Firm*—F. M. Arbuckle; W. Lohff; R. N. Muehleman

[57] ABSTRACT

This invention relates to an electrical assembly, such as an electrical cable assembly, to electrical elements such as electrical connector elements for terminating the assembly, and to housings for electrical elements. The housings for the electrical elements are formed of first and second housing members of insulating material, the housing members having mating sides which are fitted together to form the members into a housing. The first member has a plurality of pins projecting from the mating side thereof and the second member has a hole therethrough for each of the pins. The length of the pins and the relative position of the pins and holes are such that each pin passes through the corresponding hole and is exposed on the side of the second member opposite the mating side. The exposed portion of each pin is cold-flow expanded to hold the members together. At least one of the members has one or more grooves formed in its mating side in which groove an electrical contact or other electrical component may be positioned and held. For a preferred embodiment of the invention, at least one of the pins passes through a hole in each contact to hold the contacts in the housing. Each housing also has a thin projecting rear portion with a stud or studs projecting therefrom.

2 Claims, 11 Drawing Figures

Fig. 1
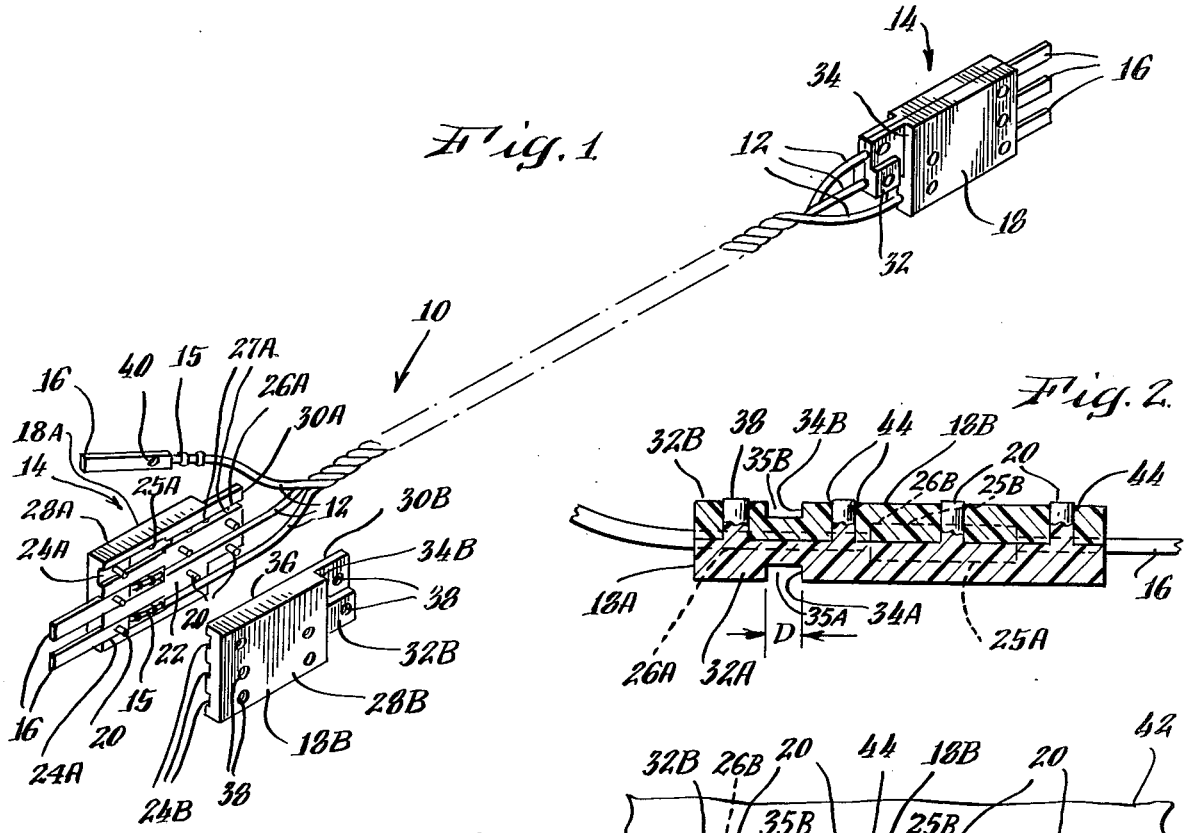
Fig. 2.
Fig. 3.
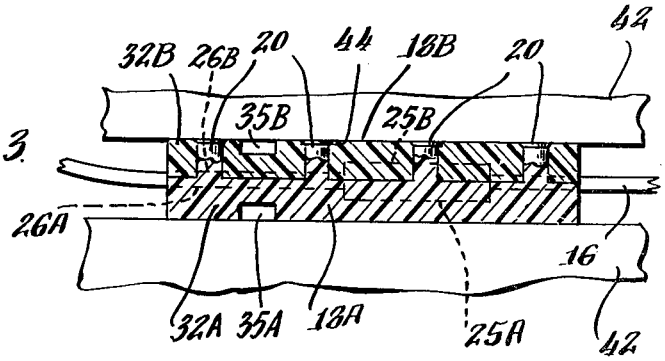
Fig. 4A.
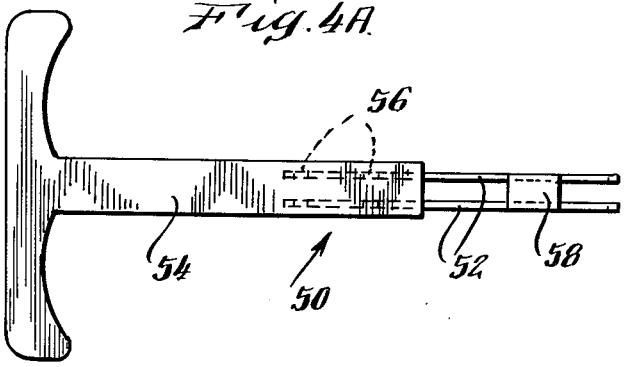
Fig. 4C.
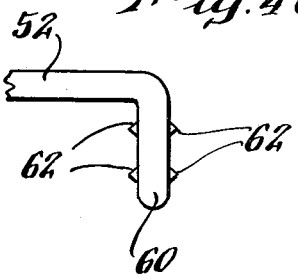
Fig. 4B.
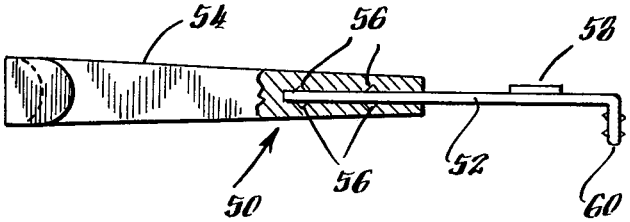

ELECTRICAL CONTACTING ELEMENT

This is a continuation, application of application Ser. No. 538,475, filed Jan. 6, 1975, now abandoned which in turn was a continuation of application Ser. No. 345,713, filed Mar. 28, 1973, now abandoned.

This invention relates to an electrical assembly, such as an electrical cable assembly, to electrical elements such as electrical connector elements for terminating the assembly, to housings for electrical elements, to a tool for inserting and removing the housings, to the method of fabricating the housings and to the method of inserting and removing the housings.

BACKGROUND OF THE INVENTION

Two significant problems in the design and use of cable assemblies are the manufacture of cable terminating elements for connecting the cables to other electrical components and the insertion and withdrawal of the terminating elements from a mating panel or other component in space limited applications where the terminating elements are densely packed. The terminating elements normally consist of contacts attached to the ends of the cable conductors which contacts are supported in some type of housing. The contacts may, for example, be crimped or soldered to the conductors, with the housing being injection molded as a single piece over the contacts and cable or formed as two pieces by molding or similar procedures which pieces are screwed together, are glued together, or are in some way thermally bonded. The injection molding operation, while providing an excellent housing, is relatively slow and may therefore be utilized only where a small number of assemblies are required or where a great deal of equipment may be committed to the operation. The molding operations required to form the housing in two parts may be quickly and easily performed. However, the screwing of the two parts together is undesirable since first, it requires an extra part, and second, the screwing operation is not easily automated and is thus time consuming. Gluing does not normally provided a satisfactory bond while the various thermal bonding techniques are relatively expensive. A need therefore exists for a housing for a cable terminating element or for use with other electrical devices which housing may be quickly, inexpensively and easily formed, preferably without requiring any parts in addition to a pair of molded housing members.

Housing elements are normally inserted and removed manually. However, in high density applications, there is normally not enough space between housings to permit the housings to be manually grasped for insertion or removal. While some tools have been developed for this purpose, they have normally been either relatively complicated, and thus expensive to make and difficult to use, or have not provided for positive gripping of the component. A simple, inexpensive, easily used tool for component insertion and removal, which tool provides for positive gripping of the housing, is thus required. Since the component to which the housing is to be mounted is frequently in relatively dark and inaccessible places, an additional useful feature on any component insertion and removal tool would be a capability for lighting the work area during the insertion and removal operations.

SUMMARY OF THE INVENTION

In accordance with the above, this invention provides a cable assembly terminated at at least one end in a contact housing formed of first and second housing members, the housing members being of an insulating material. The housing members have mating sides which are fitted together to form the members into a housing, the first member having a plurality of pins projecting from the mating side thereof and the second member having a hole therethrough for each of the pins. The length of the pins and the relative position of the pins and holes are such that each pin passes through the corresponding hole and is exposed on the side of the second member opposite the mating side. The exposed portion of each pin is cold-flow expanded to hold the members together. At least one of the members has one or more grooves formed in its mating side in which groove an electrical contact or other electrical component may be positioned and held. For a preferred embodiment of the invention, at least one of the pins passes through a hole in each contact to hold the contacts in the housing. Each housing also has a thin projecting rear portion with element insertion or removal means adapted to coact with a suitable tool for element insertion or removal. The rear portion has a stud projecting from at least one of its sides, the stud being spaced a predetermined distance from the nonprojecting portion of the housing. For a preferred embodiment of the invention, the studs project from both sides of the projecting portion and form rearwardly covered openings accessible within the perimeter of the rear portion by lateral insertion of a tool into the openings without interference with conductors laterally spaced apart on the thin projecting portion. A tool is provided for inserting and withdrawing a housing, the tool having a pair of substantially parallel and substantially straight bars which bars are spaced by a distance sufficient to permit the thin projecting portion to pass therebetween. Each of the bars is bent at a substantially right angle at its forward end, the short, bent-over section of each bar beyond the right angle bend having a thickness substantially equal to the predetermined distance which the stud is spaced from the nonprojecting portion. A means is also provided for terminating the non-bent end of the bars, the terminating means being adapted to permit gripping of the tool for controlling the movement of the bars. For preferred embodiments of the invention, the terminating means is a T-shaped handle or a lens adapted to be fitted to the end of a hand-held light source. To insert or withdraw a housing, the rear portion of the housing is fitted between the bars of the tool, and the tool is moved forward on the projecting portion until the front of the tool is substantially against the nonprojecting portion of the housing. The tool is then moved down to fit the bent-over portion of each tool bar behind the corresponding stud, the bent-over portion of the bar fitting snugly in the opening formed between each stud and the non-projecting portion of the housing. The tool is then either pushed in or pulled out to respectively insert or remove the housing.

The foregoing and other objects, features and advantages of the invention will be apparent from the following more particular description of preferred embodiments of the invention as illustrated in the accompanying drawings.

BRIEF DESCRIPTION OF DRAWINGS

FIG. 1 is a perspective view of a cable assembly of a preferred embodiment of the invention, one of the terminating elements being shown exploded.

FIG. 2 is a sectional view of a contact element of a preferred embodiment of the invention at an intermediate stage of the element manufacturing operation.

FIG. 3 illustrates the cold-flow expanding operation on the connector element of FIG. 2.

FIGS. 4A and 4B are a top view and side view respectively of a housing insertion and removal tool suitable for use with the embodiment of the invention shown in FIGS. 1–3.

FIG. 4C is an enlarged view of the bent-over portion of a bar of the tool shown in FIGS. 4A and 4B.

DETAILED DESCRIPTION

Figure 5:
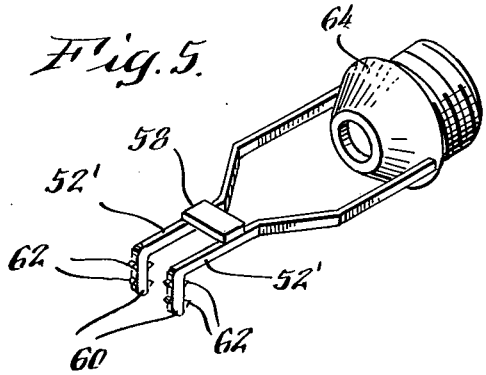
FIG. 5 is a perspective view of an alternate insertion and removal tool.

Referring now to FIG. 1, it is seen that the assembly consists of a cable 10, shown in the figure for purposes of illustration and having three conductors 12, which cable is terminated at either end by a connector element 14. Cable 10 is shown as being twisted to reduce the effects of electromagnet interference, such as RMS crosstalk.

While for some applications, the contact elements 14 may be different, for example one being a male element and the other a female element, for the preferred embodiment of the invention illustrated in FIG. 1, the elements are identical. Therefore only one of the elements 14 will be described in detail.

Referring particularly to the exploded-view portion of FIG. 1, it is seen that each element 14 has three metal contacts 16, one of which is crimped to a prestripped end of each conductor 12. The crimp-on contacts 16 have crimp barrels 15 and are brass-gold plated for a preferred embodiment of the invention. However, it is within the contemplation of the invention to utilize other contacts including contacts adapted to be soldered, welded or otherwise secured to the conductors. The thin, generally flat housing 18 for each element 14 is formed of two housing members 18A and 18B. Each of the housing members 18A and 18B is preferably molded as a single piece and is of an insulating material. A plurality of pins 20 project from mating side 22 of member 18A. The forward-most ones of the pins 20 are positioned in contact receiving grooves 24A formed in face 22 of the member. The rear portion 25A of each groove 24A is slightly deeper than the remainder of the groove and is adpated to receive crimp barrel 15. The remainder of the pins 20 are positioned between the slots 24A and between wire receiving extensions 26A of the grooves 24A. Extensions 26A have strain relief ridges 27A formed therein which engage the insulation of wires 12 to prevent the wire from being pulled out of contacts 16 when force is applied to the wire. Member 18A has a forward portion 28A in which the contacts 16 are positioned and a longitudinally disposed rear portion 30A of reduced thickness. A stud 32A having a substantially square cross-section projects from portion 30A. The stud 32A is spaced from the rear wall 34A of portion 28A by a predetermined distance D, an opening 35A thus being provided between the stud and the wall.

Housing member 18B also has contact receiving grooves 24B for securing the contacts in forward portion 28B and conductor receiving grooves 26B with strain relief ridges 27B (not shown) formed in its mating side 36. Member 18B similarly has an enlarged forward portion 28B, a rear portion of reduced thickness 30B and, a stud 32B which is spaced by a distance D from a rear wall 34B of portion 28B to from opening 35B. Member 18B differs however from member 18A in that it has a hole 38 formed therethrough at a position corresponding to the position of each of the pins 20. Thus, there is a hole 38 in the forward portion of each of the slots 24B.

To assemble a connector element 14, a predetermined amount of insulation is stripped from the desired end of each of the conductors 12 and a contact 16 crimped onto the end of each of the conductors. The contacts are then positioned in grooves 24A of housing member 18A with the pin 20 in each groove passing through a corresponding hole 40 formed in each contact. The conductors attached to each contact are positioned in grooves 26A. The depth of grooves 24A and 26A are such that roughly half the contacts and the conductors respectively projects above the grooves when the operations described above have been completed.

The next step in the operation is to position housing member 18B on housing member 18A with each pin 22 passing through the corresponding hole 38 and the faces 22 and 36 in contact with each other. Since the length of each pin 20 is slightly greater than the thickness of housing member 18B at least in the area of the corresponding hole 38, the pin projects slightly (for example, $15\times10^{-3}$ or 1/64th inch) above the top of member 18B when this step in the operation has been completed. FIG. 2 illustrates the appearance of the element when this stage in the operation has been completed. To secure the two housing members together, the assembly is placed in a suitable device 42 for applying pressure (at, for example, 500 to 10,000 PSI) to the exposed projecting portions of pins 20, causing the pins to cold-flow expand. The cold-flow expansion of the pins enlarges the projecting portion of each pin so that it can no longer fit through the corresponding hole 38. The two housing members are thus held together to form the contact element housing 18. FIG. 3 illustrates the cold-flow expansion operation. In order to provide a smooth upper surface for housing 18, holes 38 have a slight countersink 44 at the top of housing member 18B, providing a space for the expanded ends 46 of pins 20.

INSERTION AND REMOVAL TOOL AND OPERATION

FIGS. 4A, 4B and 4C show a tool which may be utilized for inserting and removing connector elements 14 from a panel or other device adapted to be connected to by the connector elements. The tool 50 consists of a pair of substantially parallel and substantially straight bars 52 embedded in a T-shaped plastic handle 54. Handle 54 may, for example, be injection molded onto bars 52 with the bars each being provided with barbs 56 near their rear end to secure the bars in the handle. A plate 58 is soldered, welded or otherwise secured on top of both bars 52 and serves to keep the bars parallel when the tool is in use. The forward end of each bar 52 is bent at a right angle near its forward end. As may be best seen in FIG. 4C, the bent-over portion 60 of each bar 52 has teeth 62 formed on both its forward and rear sides.

Figure 6A:
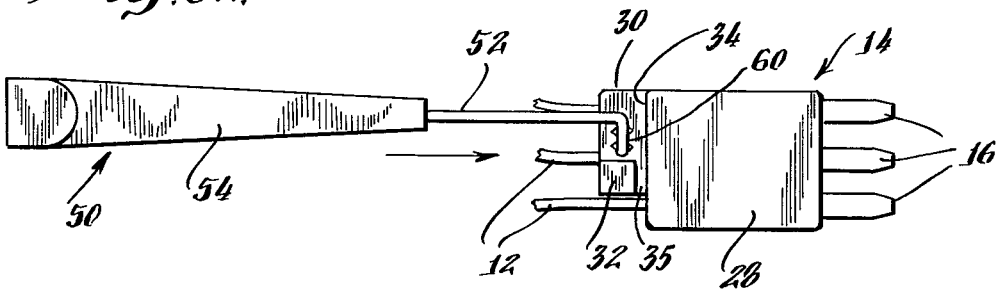
FIGS. 6A, 6B and 6C are side views of a tool and housing of a preferred embodiment of the invention illustrating the relative positions of the tool and housing during various stages of the housing insertion and removal operation.
Figure 6B:
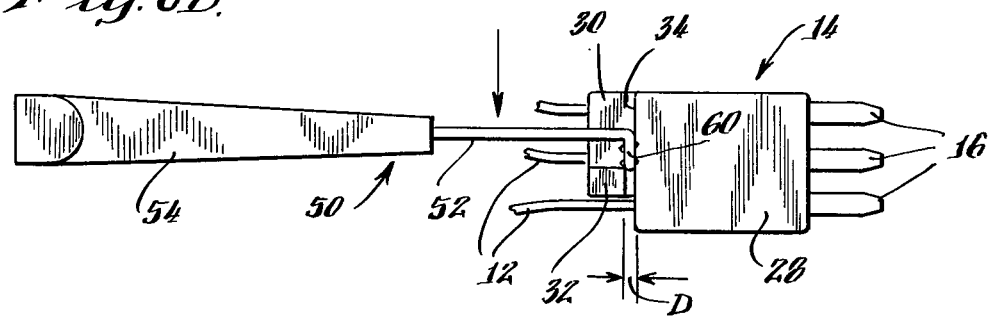
Figure 6C:
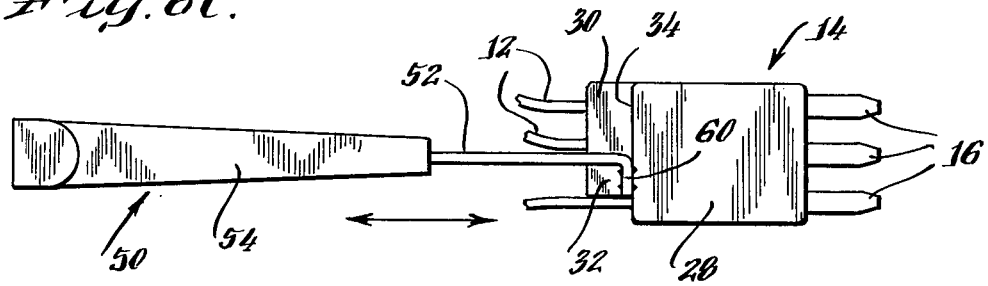

Referring now to FIGS. 6A–6C, it is seen that in using the tool 50 to insert or remove a contact element 14, the first step in the operation is to fit the thin portion 30 of the housing 18 between bars 52 of the tool (FIG. 6A), and to then move the tool back on the thin section 30 over studs 32 until the foward face of the tool is substantially in contact with wall 34. This is the position shown in FIG. 6B. The tool is then moved down to fit forward portion 60 of each bar 52 behind the corresponding stud 32, or, in other words, into the opening 35 of length D between stud 32 and wall 34 (FIG. 6C). The length D is selected such that it is substantially equal, but perhaps just slightly greater, than the thickness of bent-over portion 60 with teeth 62. Teeth 62 insure good engagement between the tool and both stud 32 and wall 34. Once tool 50 is in this position, an element 14 may be inserted by pushing the tool forward, the friction between bars 58 and housing portion 30 and between bar portions 60 with their teeth 62 and the walls of stud 32 and wall 34 assuring that the element is held on the tool during this operation, or the contact element may be removed by pulling back on the tool. When the insertion or removal operation has been completed, tool 50 is removed from element 14 by reversing the sequence of operations described above. More specifically, sufficient force is applied to tool 50 in the upward direction to overcome the frictional engagement described above, moving the tool to substantially the position shown in FIG. 6B. The tool is then pulled back to remove it from element 14.

In some applications, the device or mating connector to which the connector element 14 is to be connected is in a relatively dark and inacessible position. For these applications, a tool of the type shown in FIG. 5 may be utilized. This tool also has a pair of substantially straight and parallel bars 52' which bars have the bent-over portion 60 and teeth 62 of the type previously described. The plate 58 is also provided for maintaining the relative position of the bars. However, beyond the plate 58, the bars 52' diverge and are fitted at their rear ends into the sides of a lens casing 64 which casing is adapted to be screwed or otherwise secured to a standard flashlight. Barbs (not shown) are provided on the rear end of bars 52' to hold the bars in casing 64 in the same manner that barbs 56 hold the bars in handle 54. The manner of using the tool shown in FIG. 5 is identical to that described above with respect to the tool of FIGS. 4A–4C.

Figure 7:
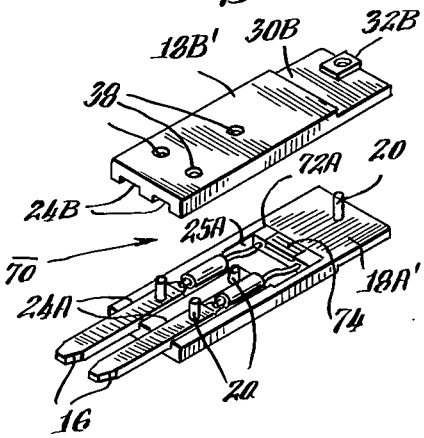
FIG. 7 is an exploded perspective view of a resistance shunt element of an alternative embodiment of the invention.

FIG. 7 illustrates a shunting resistance element 70 utilizing the housing of this invention. Element 70 may, for example, be utilized to load a circuit which does not have an assembly attached to it. The shunting element is formed of housing members 18A' and 18B'. Member 18A' has grooves 24A with enlarged portions 25A. The portions 25A terminate in an enlarged rearwardly covered recess 72A which extends laterally between portions 25A. Pins 20 project from each of the grooves 24A, from a point between the portions 25A, and from a point near the rear of the member. A contact 16 is positioned in each of the grooves 24A and is crimped to a lead of a resistor 74. Member 18B has holes 38 corresponding to the pins 20, grooves 24B, enlarged portions 25B and a slot 72B (not shown). Members 18A and 18B are fitted together and secured in the same manner as previously described for connector elements 14. Element 70 also has a portion 30 of reduced thickness with studs 32 projecting therefrom. The studs 32 for this embodiment of the invention are shown as being positioned near the center of portion 30 rather than at one end and as being of a rectangular rather than square cross-section. However, these studs are utilized in conjunction with a tool 50 for inserting and removing the element 70 in a panel or similar device in the same manner as that previously described for the elements 14.

A cable assembly has thus been provided which is terminated at either end by connector elements which may be quickly, easily, and inexpensively fabricated without the need for extra holding parts or the application of heat. The connector elements are also designed to be easily inserted and removed by use of a simple novel tool even when the insertion or removal is to be performed in tight quarters, or in relatively inaccessible or dark places. It is apparent that while the techniques described above have been primarily with respect to a connector housing, the housing, and the method of fabricating the housing, may be utilized for packaging a shunt element such as the element 70 or other electrical components to which electrical connection is to be made. Thus, the housing may have the configuration shown in FIG. 7 or grooves 24 themselves may be adapted to have a resistor, capacitor, or other electrical component fitted therein in addition to or instead of the electrical contacts 16. It is also apparent that while the tool 50 has been shown with a T-shaped handle and mounted on the lens housing of a flashlight, other suitable elements might be utilized for mounting the bars 52. Further, while a housing adapted to contain three contacts has been shown in FIG. 1, it is apparent that the teachings of this invention could be utilized with as few as one contact or as many contacts as might be required in a given application. The shape of housing 18, the number and placement of pins 20 and holes 38, and the position and shape of studs 32 may also vary with application.

Thus, while the invention has been particularly shown and described above with respect to preferred embodiments thereof, the foregoing and other changes in form and detail may be made therein by one skilled in the art while still remaining within the spirit and scope of the invention.

What is claimed is:

1. An electrical connecting element comprising a thin, generally flat insulating housing including longitudinally disposed forward and rear portions, at least two electrical contacts secured in said forward portion and extending forwardly therefrom for connection to a mating connector, the rear portion including a perimeter, a thinned, longitudinally-projecting portion within said perimeter including at least two longitudinal grooves laterally separated for receiving a pair of conductors and strain relief means disposed within each groove, and element removal means for removing said element from said mating connector and laterally disposed apart from said grooves, said removal means including at least one rearwardly-covered lateral opening accessible within said perimeter by lateral insertion of a tool into said opening without interference by said conductors, said housing including first and second housing members each formed on an insulating material, said members having mating sides which are fitted together to form the members into a housing for the element, said first member having a plurality of pins projecting from the mating side thereof, said second member having a hole therethrough for each of said pins, the length of said pins and the relative positions of said pins and holes being such that each pin passes through a corresponding hole and is exposed on the side of said second member opposite its mating side, the portion of each pin exposed beyond the second member being cold-flow expanded to hold the members together, at least one of said members having one or more grooves formed in its mating side, one of said electrical contacts being positioned and held in each of said grooves, at least one of said contacts having at least one hole formed therethrough.

and at least one of said pins being positioned to pass through a hole of a contact, when the element is fully assembled, to hold the contact in the housing.

2. A cable assembly comprising a selected length of cable with opposite ends and containing at least two laterally separated conductors; and a pair of terminating elements, each element mounted at one of said ends of said cable and including a thin, generally flat insulating housing including longitudinally disposed forward and rear portions, at least two electrical contacts secured in said forward portion and extending forwardly therefrom for connection to a mating connector, the rear portion including a perimeter, a thinned, longitudinally-projecting portion within said perimeter including at least two longitudinal grooves laterally separated and adapted to receive said conductors, and strain relief means disposed within each groove, and element removal means for removing said element from said mating connector and laterally disposed apart from said grooves, said removal means including at least one rearwardly-covered lateral opening accessible within said perimeter by lateral insertion of a tool into said opening without interference by said conductors, said housing including first and second housing members each formed of an insulating material, said members having mating sides which are fitted together to form the members into a housing for the element, said first member having a plurality of pins projecting from the mating side thereof, said second member having a hole therethrough for each of said pins, the length of said pins and the relative positions of said pins and holes being such that each pin passes through a corresponding hole and slightly beyond the side of said second member opposite its mating side, the portion of each pin extending beyond the second member being cold-flow expanded to hold the members together, at least one of said members having a groove formed in its mating side for each of the cable conductors, and one of said electrical contacts positioned and held in each of said grooves, each contact being attached at one end to one of said conductors and being adapted at its other end for connection with a mating contact, each of said electrical contacts having at least one hole formed therethrough, and each contact having at least one of said pins positioned to pass through a hole of such contact, when the element is fully assembled, to hold the contact in the housing.

* * * * *